US008893851B2

(12) United States Patent
Kitamura

(10) Patent No.: US 8,893,851 B2
(45) Date of Patent: Nov. 25, 2014

(54) SOUNDPROOFING PLATE WHICH DOES NOT OBSTRUCT AIRFLOW

(76) Inventor: Yoshiharu Kitamura, Tokyo (JP)

( * ) Notice: Subject to any disclaimer, the term of this patent is extended or adjusted under 35 U.S.C. 154(b) by 0 days.

(21) Appl. No.: 13/995,056

(22) PCT Filed: Dec. 21, 2011

(86) PCT No.: PCT/JP2011/079623

§ 371 (c)(1),
(2), (4) Date: Jun. 17, 2013

(87) PCT Pub. No.: WO2012/086680

PCT Pub. Date: Jun. 28, 2012

(65) Prior Publication Data

US 2013/0270035 A1 Oct. 17, 2013

(30) Foreign Application Priority Data

Dec. 21, 2010 (JP) ..... 2010-294763

(51) Int. Cl.

| | |
|---|---|
| ***E04B 1/84*** | (2006.01) |
| ***E04B 1/82*** | (2006.01) |
| ***E04B 1/86*** | (2006.01) |
| ***G10K 11/172*** | (2006.01) |
| *E04B 1/74* | (2006.01) |
| *G10K 11/16* | (2006.01) |

(52) U.S. Cl.

CPC ..... *G10K 11/161* (2013.01); *E04B 1/86* (2013.01); *G10K 11/172* (2013.01)

USPC ..... 181/293; 181/210; 52/144

(58) Field of Classification Search

USPC ..... 181/293, 295, 288, 210, 286, 284; 52/144, 145

See application file for complete search history.

(56) References Cited

U.S. PATENT DOCUMENTS 1,783,276 A * 12/1930 Bliss ..... 454/206
2,280,631 A * 4/1942 Coffey ..... 181/293

(Continued)

FOREIGN PATENT DOCUMENTS

JP A-63-153592 6/1988
JP A-3-192897 8/1991

(Continued)

OTHER PUBLICATIONS

Jan. 31, 2012 International Search Report issued in International Application No. PCT/JP2011/079623 (with translation).

*Primary Examiner* — Edgardo San Martin
(74) *Attorney, Agent, or Firm* — Oliff PLC

(57) ABSTRACT

A soundproofing plate includes a substrate wherein through holes are formed; and sound collecting parts, including through holes in the center, which approximately match the through holes of the substrate, the collecting parts having a shape wherein the diameter increases as the distance from the substrate increases. The sound collecting parts are disposed on both faces of the substrate. Alternatively, a soundproofing plate includes a substrate with a plurality of through holes; and attenuation elements. The attenuation elements include hollow shaft members; and sound collecting parts anchored on the end parts of the hollow shaft members. The sound collecting parts include through holes in the centers which approximately match hollow parts in the hollow shaft members; and have a shape wherein the diameter increases as the distance from the hollow shaft member increases. The hollow shaft members are disposed in the substrate to approximately match the substrate through holes.

10 Claims, 14 Drawing Sheets

(56) References Cited

U.S. PATENT DOCUMENTS

| | | | | | |
|---|---|---|---|---|---|
| 3,159,090 | A * | 12/1964 | Schutt | 454/270 |
| 3,174,580 | A * | 3/1965 | Schulz et al. | 181/290 |
| 3,814,208 | A * | 6/1974 | Morresi et al. | 181/293 |
| 3,887,031 | A * | 6/1975 | Wirt | 181/286 |
| 5,004,070 | A * | 4/1991 | Wang | 181/286 |
| 5,185,504 | A * | 2/1993 | Jen | 181/286 |
| 5,250,763 | A * | 10/1993 | Brown | 181/155 |
| 5,422,446 | A * | 6/1995 | Fries | 181/293 |
| 5,445,861 | A * | 8/1995 | Newton et al. | 428/116 |
| 5,457,291 | A * | 10/1995 | Richardson | 181/293 |
| 5,491,310 | A * | 2/1996 | Jen | 181/286 |
| 5,760,349 | A * | 6/1998 | Borchers et al. | 181/286 |
| 6,035,965 | A * | 3/2000 | Fujiwara et al. | 181/293 |
| 6,125,965 | A * | 10/2000 | Wang | 181/286 |
| 6,187,401 | B1 * | 2/2001 | Heisel et al. | 428/36.9 |
| 6,352,134 | B1 * | 3/2002 | Wang | 181/292 |
| 6,617,002 | B2 * | 9/2003 | Wood | 428/131 |
| 6,977,109 | B1 * | 12/2005 | Wood | 428/131 |
| 7,413,053 | B2 * | 8/2008 | Wasif et al. | 181/293 |
| 7,451,855 | B2 * | 11/2008 | Wang | 181/286 |
| 8,413,443 | B2 * | 4/2013 | Johnson | 60/725 |
| 8,579,080 | B2 * | 11/2013 | Angelico | 181/293 |
| 2002/0175023 | A1 * | 11/2002 | Wilson | 181/293 |
| 2009/0038883 | A1 * | 2/2009 | Kim | 181/291 |
| 2013/0265704 | A1 * | 10/2013 | Kowalczyszyn et al. | 361/679.01 |

FOREIGN PATENT DOCUMENTS

| | | | | |
|---|---|---|---|---|
| JP | A-10-39875 | | 2/1998 | |
| JP | A-2002-367298 | | 12/2002 | |
| JP | A-2003-21373 | | 1/2003 | |
| JP | 2005031240 | A * | 2/2005 | G10K 11/172 |
| JP | A-2005-221710 | | 8/2005 | |
| JP | A-2006-250022 | | 9/2006 | |

* cited by examiner

③ New Soundproofing Plate Installed on Back Surface of Rack-mounted Computer

④ Rack-mounted Computer Back Surface Temperature

1)-2 Soundproofing Plates Installed in Office Window 3 soundproofing plates with holes mounted at right edge of window Sash Windows W 700mm × H 1,800mm × 2

⑤ New Soundproofing Plate Installed in Window

※ Temperature measured at distance of 15 cm centered at window

3) Wedge-shaped Pipe Effect

4) Soundproofing Effect by Hole Size Ratio

The results of frequency distribution of jet and traffic noise are as follows

SOUNDPROOFING PLATE WHICH DOES NOT OBSTRUCT AIRFLOW

TECHNICAL FIELD

The present invention relates to a soundproofing plate for effectively reducing transmitted acoustic energy without simultaneously obstructing air flow.

BACKGROUND ART

A general method of shielding against noise from indoors or outdoors is by shutting it out with walls, doors or windows. Additionally, when noise is generated within a specific area, there are methods of sealing off the relevant area. Methods for doing so include using tightly sealable sashes for doors and windows, giving them a double structure, or using sound-absorbing materials. In any case, this usually necessitates blocking the flow of air between the source of the noise and the area to be soundproofed.

On the other hand, soundproofing methods allowing air flow include those such as the "soundproofed low energy consumption healthy living room system using natural circulation of outdoor air" described in JP 2003-21373 A, wherein box-shaped tubes with air passage holes are provided, these air passage holes are filled with a sound-absorbing material, and the boxes are provided with complicated air flow routes to reduce noise, as well as the "sound insulating material structure and soundproofing structure of an air conditioner" described in JP H10-39875 A, wherein porous through holes are added and a foamed material is used.

Alternatively, there are methods such as mufflers for reducing engine exhaust noise and noise cancellers or silencers for reducing the firing noise of guns. The "internal combustion engine exhaust noise reducing device and exhaust noise tuning method using said device" of JP 2006-250022 A has a gas flow path of at least a certain length and the flow of gas is made complicated to raise the sound insulating effect.

Furthermore, methods of canceling noise by manipulating the acoustic signal of noise, called noise-canceling speakers or noise cancellers, are known. JP 2002-367298 provides examples of noise canceller devices and noise canceling methods.

RELATED ART DOCUMENTS

Patent Documents

Patent Document 1: JP 2003-21373 A
Patent Document 2: JP H10-39875 A
Patent Document 3: JP 2006-250022 A
Patent Document 4: JP 2002-367298 A

SUMMARY OF THE INVENTION

Problems to be Solved by the Invention

In conventional soundproofing methods wherein windows or doors with tightly sealable sashes or double structures are installed to cut off offices or living spaces from outside noise from the street or airports as described above, air conditioning is needed to maintain a suitable indoor temperature even when the outside air temperature is comfortable, as a result of which electrical energy consumption, which is a factor in global warming, cannot be reduced. The same applies when the noise is indoors and must be soundproofed with respect to the outside; electrical energy is consumed for the purpose of air conditioning.

Additionally, in the soundproofed low energy consumption healthy living room system using natural circulation of outdoor air described above (JP 2003-21373 A), the box-shaped tubes with air passage holes provided on the window side are filled with a sound-absorbing material, making it difficult to pass a sufficient natural breeze, and the effects cannot be expected to be adequate to make air conditioning unnecessary. Additionally, there is a need for complicated air flow routes which requires a large size and makes application to wide areas such as door and windows structurally difficult. Furthermore, as with the above-mentioned sound insulating material structure and soundproofing structure of an air conditioner (JP H10-39875 A), in addition to not being able to pass a sufficient natural breeze, the inability to provide a transparent structure that lets in natural light necessitates indoor illumination even during the day, so instead of conserving energy, the opposite effect may occur.

Since mufflers and silencers are premised on the assumption that the direction of air flow is known and has a certain speed that is not a naturally occurring breeze, and the gas flow route must be at least a certain length to cancel the noise, they are difficult to apply to the doors and windows of offices and homes.

While the aforementioned JP 2003-21373 A and mufflers and silencers are not inapplicable to countermeasures against noise in machines having fans such as vacuum cleaners and computers, they are difficult to apply in practice due to the fact that they would become too big compared to the machines, and have no function of maintaining the temperature of the machines to below a certain level by allowing air flow. As for computers, soundproofed racks wherein the entire rack is sealed are commercially available, but each rack requires air conditioning and they are expensive compared to normal open racks, so they are very rarely applied to all the racks in a computer room. Additionally, even if a soundproofed rack can be used, the doors must be opened to make repairs in the event of malfunction or when installing software, in which case the soundproofing effect is lost. Then, the environment is the same as a normal computer room wherein the noise makes it difficult to hear voices, seriously hampering work.

On the other hand, while noise cancellers are capable of ensuring air flow, the devices are complicated and require new power supply circuits, so they are difficult to apply to vacuum cleaners and computers in which the production costs need to be reduced as much as possible. Therefore, as measures against noise in vacuum cleaners and single computers, there are almost no effective measures other than to apply a fabric or a metal plate of mesh structure enabling flow of exhaust in the periphery of the fan portion of a device.

The present invention is provided for the purpose of solving such problems of conventional structures, and for realizing a soundproofing plate that does not consume—manmade energy and enables passage of outside air.

Means for Solving the Problems

For the purpose of solving the above-described problems, the present invention offers a soundproofing plate comprising:

a substrate on which are formed a plurality of through holes; and a sound collecting portion having in the center a through hole approximately aligned with a through hole of the substrate, of a shape wherein the diameter increases as the distance from the substrate increases.

For the purposes of the present invention, a substrate is a board-shaped construction for covering an opening, consisting of a glass pane, an iron panel, a concrete panel, a precast concrete panel or a composite panel, generally with a flat planar structure, but it need not be limited to a board shape, and the material also need not be limited to the above, as long as it is capable of achieving the purpose of covering an opening. A through hole is an aperture that passes from one side of the substrate to the other, most typical of these being linear through holes having a constant diameter, but the through hole may have a bent shape, or the diameter may change in the middle. While multiple through holes are usually formed in the substrate, the possibility of having just one through hole is not excluded.

The surface of the sound collecting portion that can be seen from outside perpendicular to the substrate surface (referred to here as the "sound collecting surface") is bowl-shaped or conical, and the sound collecting portion may have such a shape overall, but the sound collecting portion may also, for example, be cylindrical overall, with the sound-collecting surface being a curved surface forming a bowl-shaped or conical concavity. Additionally, while the typical shape of a sound collecting surface is a rotated shape centered about an axis perpendicular to the substrate, the shape may have angles (seams) around the axis, such as a square pyramid or a hexagonal pyramid. While a shape wherein the diameter increases as the distance from the substrate increases is exemplified by a conical concavity, the shape of the sound collecting surface represented by a cross section containing the axis may be any kind of curve wherein the diameter increases in becoming further from the substrate.

Due to the formation of a through hole in the substrate that penetrates through the substrate and the sound collecting portion and connects the spaces on both sides of the sound collecting portion, the soundproofing plate of the present invention does not obstruct the passage of air, while simultaneously achieving remarkable soundproofing effects (sound pressure level reducing effects) as will be explained based on experimental results in later paragraphs.

The aforementioned sound collecting portion may be provided on only one side of the substrate, or may be provided on both sides (both surfaces) of the substrate. In cases where a noise source exists on only one side of the soundproofing plate and the purpose is to reduce the noise level traveling from one side to the other, or when one surface of the substrate must be made smooth, there is a need to provide a sound collecting portion on only one side of the substrate.

The soundproofing plate according to the present invention may comprise:

a substrate on which are formed a plurality of through holes; and an attenuation element comprising a hollow axial member, and a sound collecting portion affixed to an end portion of the hollow axial member, having in the center a through hole approximately aligned with a hollow portion of the hollow axial member, of a shape wherein the diameter increases as the distance from the hollow axial member increases;

wherein the hollow axial member is provided on the substrate so as to be approximately aligned with the through hole.

While the hollow axial member would most commonly be a pipe-shaped element having a through hole along the axis in the center, the cross section or the diameter of the hollow portion may vary along the axis. Additionally, the hollow axial member need not be a linear element. The length of the hollow axial member can be appropriately determined as needed, including the case where the length is substantially zero. The attenuation element may comprise a hollow axial member and a sound collecting portion provided on one end of the hollow axial member, or may have a pair of sound collecting portions provided on both ends of the hollow axial member.

The attenuation element may comprise a hollow axis and a pair of sound collecting portions provided on both ends of the hollow axis, in which case the sound pressure is reduced in both directions of passage through the soundproofing plate.

The attenuation element may be provided on only one side of the substrate, in which case the other surface of the substrate may be made smooth. Alternatively, the hollow axial member may partially protrude from the surface on the side of the substrate on which the sound collecting portion is not provided.

The soundproofing plate of the present invention may have a structure wherein the hollow axis penetrates the substrate, and a sound collecting portion is provided on at least one end of the hollow axis.

The substrate may have a structure comprising mutually parallel first and second substrates, wherein the hollow axial member penetrates through the first and second substrates.

While the first and second substrates may be of the same material and the same dimensions, they do not need to be so limited. The first and second substrates may have a structure connected by the hollow axial member. Alternatively, the first and second substrates may have a structure connected by an attenuation element. There may be a space between the first and second substrates, or the space may be filled by a material that is the same or different from the substrate and integrated therewith.

The substrate may comprise mutually parallel first and second substrates, and the sound collecting portion may be housed between the surfaces of the first and second substrates so as not to protrude outside the two substrates. In this case, one or both surfaces of the soundproofing plate may be made smooth.

The shape of the sound collecting portion is preferably one of spherical, elliptical, parabolic or conical, but the shape need not be limited to these. Additionally, while the cross section containing an axis perpendicular to the substrate surface may be a curve whose diameter increases as the distance from the substrate increases, the curve may be such that the diameter conversely decreases as the distance from the substrate further increases, in other words, the sound collecting surface may have a shape forming a vase-shaped space with a small mouth.

The shape of the sound collecting portion may be that of a three-dimensional surface traced by moving a two-dimensional arc, ellipse, parabola, hyperbola or straight line in a direction perpendicular to the two-dimensional plane, wherein the edge portion is rectangular. Furthermore, the movement may be movement along a curve rather than straight-line motion along the direction perpendicular to the two-dimensional surface. The sound collecting surface may, for example, have the shape of an upright square pyramid composed of four planes, a hexagonal pyramid, or an octagonal pyramid, and the inclined surface of the sound collecting surface appearing at a cross section cut at a plane containing an axis perpendicular to the plane of the substrate may be an outwardly bulging curve or an inwardly bulging curve instead of a straight line. Furthermore, the shape of a cross section of the sound collecting surface when cut on a plane parallel to the surface of the substrate may be a circle, or may be a polygon, an outwardly bulging polygon, or an inwardly bulging polygon.

The sound collecting portions may be provided such that the edge portions come into mutual contact, substantially covering the entire area of the substrate. In particular, when the shape of a cross section of the sound collecting surface cut along a plane parallel to the surface of the substrate is rectangular or square, the sound collecting portion can easily be provided so as to substantially cover the entire area of the substrate.

Effects of the Invention

In addition to the above-described effects, according to the soundproofing plate of the present invention, the flow of gas including natural breezes is possible through the soundproofing plate having holes, and when applied to windows or doors, air conditioning which was necessary even when the outside air temperature is comfortable becomes unnecessary, so considerable energy conservation effects can be achieved year-round.

The flow of gas including natural breezes is possible through the soundproofing plate having holes, and when applied to windows or doors, air conditioning which was necessary even when the outside air temperature is comfortable becomes unnecessary, so considerable energy conservation effects can be achieved year-round.

The noise from fan portions of vacuum cleaners and computers can also be soundproofed while holding the temperature of devices constant, with a simple structure affixed to the periphery of the fan portion. As a result, not only does it become possible to hear voices over the telephone or on television while operating a vacuum cleaner, but the noise is reduced to a level enabling the voices of small children or voices warning of emergencies to be heard, greatly increasing household safety.

Additionally, when applied to computers, soundproofed racks are unnecessary and the air conditioning energy in soundproofed racks required for holding the temperature of devices constant becomes unnecessary. Furthermore, the work environment in computer rooms which was hampered due to noise is significantly improved. The noise from the fan portions of vacuum cleaners and computers also can be soundproofed while holding the device temperature constant, with a simple structure just attached to the periphery of the fan portion.

Additionally, when applied to computers, soundproofed racks are unnecessary and the air conditioning energy in soundproofed racks required for holding the temperature of devices constant is made unnecessary. Furthermore, the work environment in computer rooms which was hampered due to noise is significantly improved.

The soundproofing plate of the present invention, when installed in industrial machinery having noise sources such as diesel engines, generators, work tools and milling equipment, ensures air flow for gas delivery or gas exhaust necessary for the noise source, while at the same time achieving sufficient soundproofing effects, thereby reducing noise outside or in factories in the working environments of workers.

MODES FOR CARRYING OUT THE INVENTION

Herebelow, modes for carrying out the present invention will be explained in detail with reference to the drawings as needed. However, the examples of the present invention described below are intended as illustrative examples for aiding understanding of the present invention, so the present invention should not be construed as being limited to the examples, experimental examples or embodiments described below.

Embodiment 1

Herebelow, a first embodiment of the present invention will be described.

Figure 1:
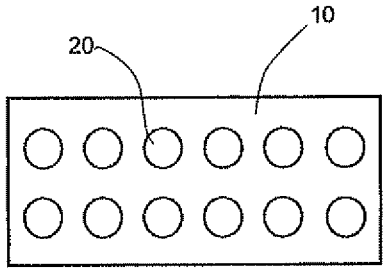
FIG. 1 A substrate with holes according to a first embodiment of the present invention.

FIG. 1 is a schematic view showing a substrate 10 for forming a soundproofing plate 200 according to the present invention. The substrate 10 has twelve through holes 20 arranged in two rows. To describe the respective dimensions for reference purposes, the substrate 10 is 300 to 450 mm long in the lateral direction in the drawing, the through holes 20 have a diameter of 15 to 40 mm, and the holes have a pitch of about 60 to 180 mm. The through holes 20, as is evident by their name, are apertures that penetrate through the substrate 10.

Figure 2:
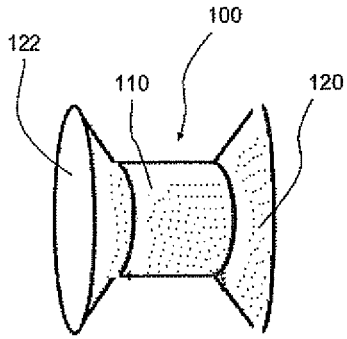
FIG. 2 A schematic view of an attenuation element according to the first embodiment of the present invention.

On the other hand, FIG. 2 is a schematic view showing an attenuation element 100 according to the present invention. The attenuation element 100 comprises a hollow axial member 110 and a pair of sound collecting portions 120 provided on both end portions thereof. The concave surface portions of the sound collecting portions 120 form sound collecting surfaces 122. While not visible in FIG. 2, a through hole 130 is formed along the axis in the central portion of the hollow axial member 110. The sound collecting surface 122 also has a through hole 130 formed in a bottom portion, as a result of which a through hole 130 along the axis of the hollow axial member 110 is formed in the attenuation element 100. In FIG. 2, the outer diameter of the hollow axial member 110 is about half the maximum diameter of the sound collecting portion 120, but this ratio may be set as needed or to optimize design. Generally, the ratio of the outer diameter of the hollow axial member to the maximum diameter of the sound collecting portion should preferably be in the range of 1/8 to 1/1. Additionally, while not limited thereto, the attenuation element 100 may, for example, be composed of an acrylic material, and have a length in the axial direction of 5 to 100 mm, the thickness of the sound collecting portion 120 may be about 1 to 10 mm, and the diameter of the through hole 20 may be about 10 to 50 mm.

Figure 3:
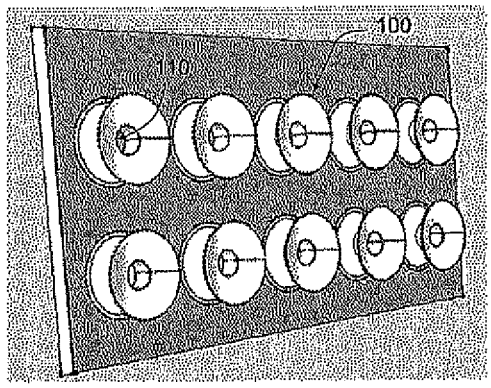
FIG. 3 A schematic view of a soundproofing plate according to the first embodiment of the present invention.

FIG. 3 shows a soundproofing plate 200 having an attenuation element 100 affixed to the substrate 10. Since one edge portion of the sound collecting portion 120 is bonded to the substrate 10, the attenuation element 100 is entirely present on only one side of the substrate 10. In this case, the diameter of the through hole 20 formed in the substrate 10 only need be smaller, than the maximum diameter of the sound collecting portion 120, and it does not need to have the same diameter of the through hole 130 formed in the hollow axial member 110 or the sound collecting portion 120.

Figure 4:
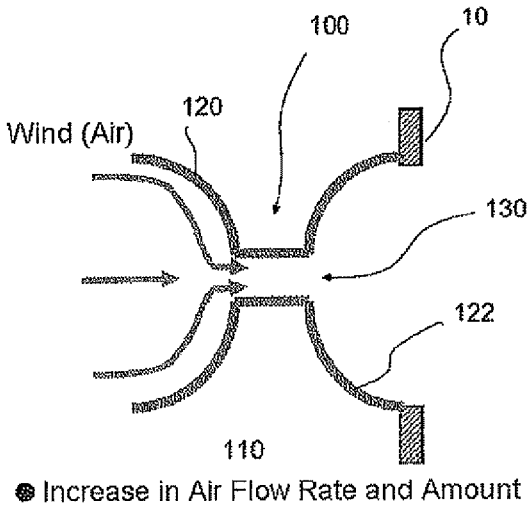
FIG. 4 A section view (schematic) of an attenuation element according to the present invention.

FIG. 4 schematically shows the flow of air and propagation of sound through a soundproofing plate 200 having such a structure. The air flow from the left is collected at the sound collecting surface 122 and passes through the through hole 130 to the opposite side of the soundproofing plate 200. On the other hand, most of the sound waves reaching the soundproofing plate 200 from the left are reflected by the sound collecting surface 122 of the sound collecting portion 120 and interfere with each other, but a small portion passes through the through hole 130 and reaches the opposite side. Furthermore, the sound waves are reflected and attenuated by the sudden changes in the cross section at the entrance and exit positions to the through hole 130.

Figure 5:
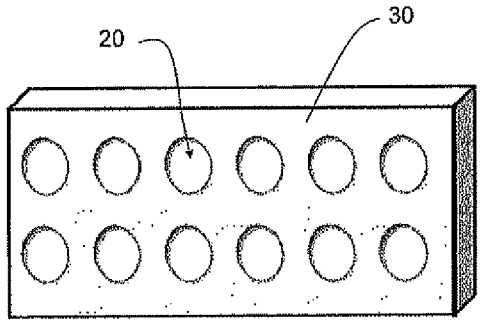
FIG. 5 A substrate with holes according to a second embodiment of the present invention.
Figure 6:
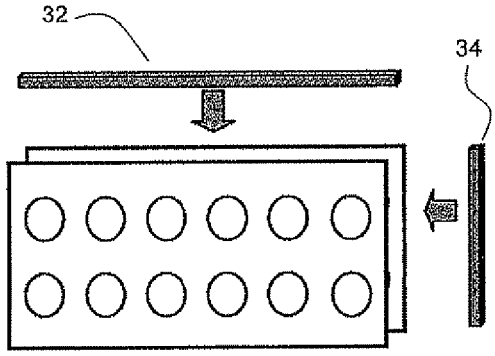
FIG. 6 A schematic view showing a structure of a substrate with holes according to the second embodiment of the present invention.

FIG. 5 shows a double substrate 30 in a second embodiment of the soundproofing plate 200 according to the present invention. As shown in FIG. 6, the second embodiment differs from the first embodiment in that the substrate 10 is an assembly composed of first and second substrates 10, top and bottom plates 32, and side plates 34. The space between the double substrate 30 may be empty, filled with a material such as a soundproofing material, or filled with the same material. When filled with the same material, it is no longer a double substrate, but corresponds to a single thick substrate having an overall thickness including the double substrate and the space in between.

Figure 7:
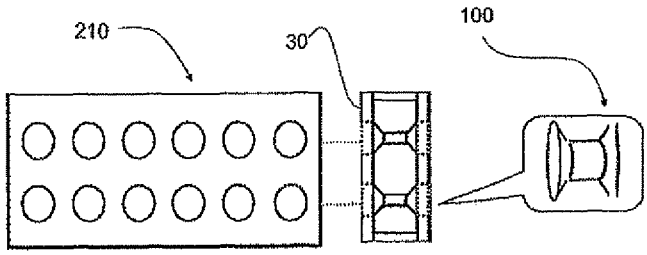
FIG. 7 A front view and section view of a substrate with holes according to the second embodiment of the present invention.

Furthermore, as shown in FIGS. 6 and 7, the second embodiment 210 differs in that the attenuation element 100 is completely buried inside the thickness of the substrate 10. In other words, the outer edge portions of the two sound collecting portions 120 of the attenuation element 100 are fixed so as to be at substantially the same position as the surface position of the substrate 10. The shape of the attenuation element 100 itself is the same as in the first embodiment.

Figure 8:
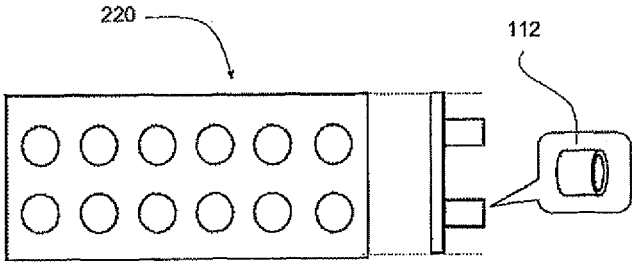
FIG. 8 A schematic view of a soundproofing plate according to a third embodiment of the present invention.

FIG. 8 shows a third embodiment 220 of the present invention. In the third embodiment, only a tubular member 112 corresponding to the hollow axial member 110 is affixed to one side of the substrate 10. In other words, there is no parabolic sound collecting portion.

[Experimental Results]

Herebelow, the results for experiments performed with respect to Embodiments 1-3 will be described.

The diameters of the through holes 20 provided in the substrate 10 were 40 mm, 25 mm and 15 mm, and in the example, twelve through holes 20 were formed. The first and second substrates 10 were made of acrylic plates of thickness 0.8 mm, length 450 mm and width 150 mm. The connecting hollow axial members 110 used in the embodiments were composed of acrylic, with diameters of 25 mm, 18 mm and 10 mm, of length 10 mm, each being smaller than the diameter of 20 of 10 described above. The sound collecting portions 120 are of a shape for achieving a tight, gapless contact with the through holes, with an axial length of 3 mm. However, when wishing to raise the transparency, they may be made with glass, and the cross sectional shapes of the through holes and pipes may be circular or polygonal. The soundproofing effect can be further improved by using plates and pipes, and using sound-absorbing material in the gaps.

The soundproofing plate 200 according to the present invention is installed on windows or doors, or on machinery that generates noise. In the case of the present invention, a through hole 20 is formed in the substrate 10 (in the case of Embodiment 2, a pair of substrates 10 connected by a hollow axial member 110), so outside air and machinery exhaust can freely pass, and the temperature of the soundproofed area is not isolated from the outside air, instead approaching a neutral temperature with the outside air temperature in accordance with the law of entropy. For this reason, there is no need for continuous air conditioning of living space or machinery that is not suitable for temperature increases, and energy consumption can be largely reduced.

Figure 14:
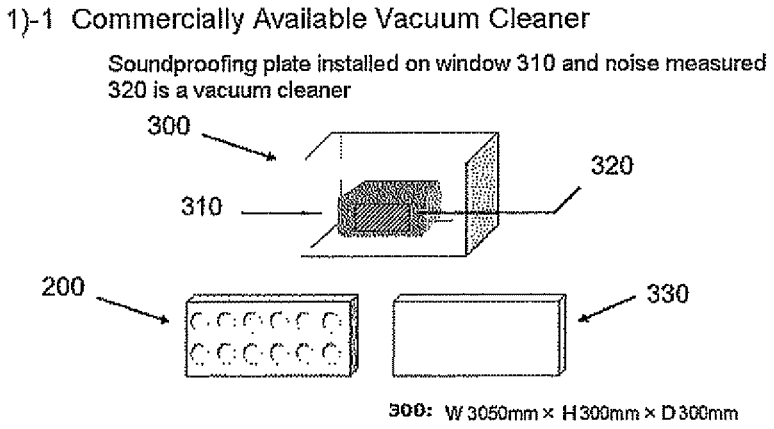
FIG. 14 An experimental arrangement for a test of the soundproofing effect with respect to vacuum cleaner noise.

FIG. 14 is an example of an experimental apparatus for the structure of the present invention. The above-described soundproofing plate 200 or a double substrate 10 without holes was affixed at the front surface aperture 310 of the box 300, and the gaps with the front surface aperture portion were sealed with duct tape. A speaker was placed inside the box 300 as a noise source 320, to reproduce various types of noise. The wiring between the noise source 320 and the amp was passed through the back surface of the box 300, and the gap here was also sealed with duct tape, then vehicular noise recorded on the street was played. The volume of the noise issuing from the noise source 320 was 100.7 dB. The soundproofing plate 200 with varying hole diameter was replaced with a double substrate 10 without holes, and the sound was measured at a point 30 cm outside each plate.

Figure 17:
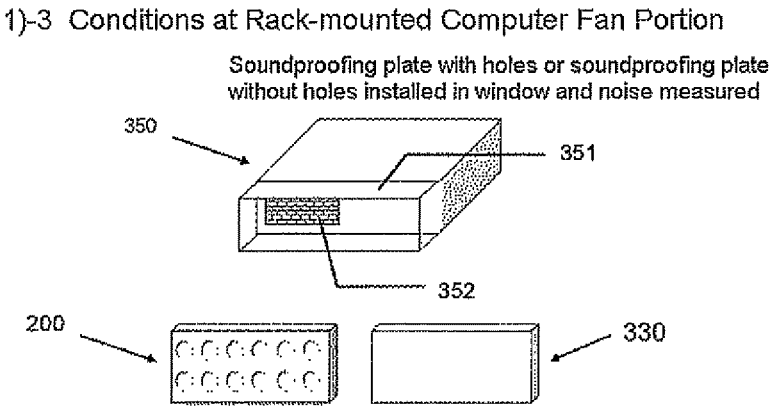
FIG. 17 An experimental arrangement for a test of the soundproofing effect with respect to rack-mounted computer noise.

FIG. 17 shows experimental apparatus roughly the same as that shown in FIG. 14, but differing in that a noise source 352 which is a rack-mounted computer was installed as the noise source 320 instead of a speaker. The installation of the soundproofing plate 200 and the double plate 330 without holes was similar.

Figure 20:
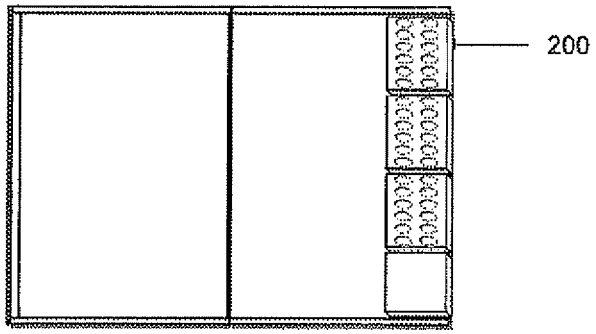
FIG. 20 An experimental arrangement for a test of the soundproofing effect of a sash window in an office.

FIG. 20 is a drawing that shows an arrangement for testing soundproofing and breeze passage in an office. The window sashes in an actual office were partially replaced by three soundproofing plates 200, and the inside and outside noise was measured.

The experimental results are shown below.

In the tables shown below, the soundproofing plate 200 of Embodiment 1 or 2 may be referred to as a new soundproofing plate. A sealed double plate is a simple double plate lacking holes as shown in FIG. 14. Additionally, the noise inputted to the soundproofing plates 200 as measured immediately in front of the soundproofing plate 200 was expressed as the noise source.

Figure 9:
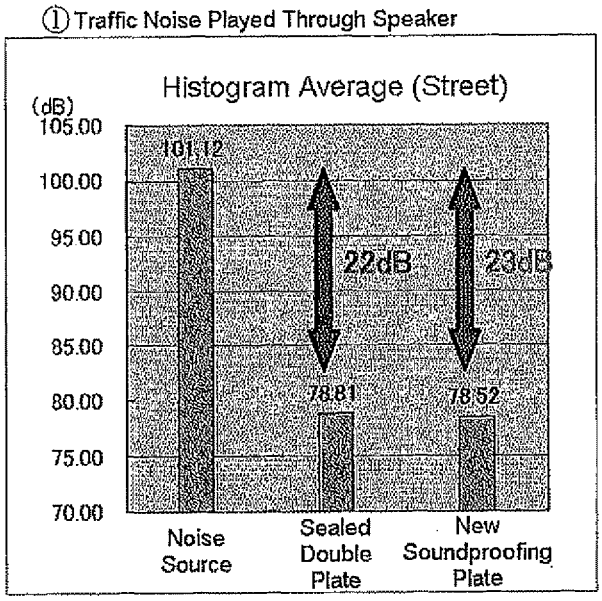
FIG. 9 A graph showing the soundproofing effect of the present invention (actual traffic noise).

FIG. 9 shows the measured results for the arrangement shown in FIG. 14, when setting the diameter of the through holes 20 of the substrate 10 from 0 (no holes) to 40 mm, and the diameter of the through holes 130 of the hollow axial members 110 from 10 to 25 mm, and using traffic noise as the noise source. In this case, the soundproofing plate of Embodiment 2 was used as the new soundproofing plate. However, the test was performed by reproducing traffic noise using a speaker instead of a vacuum cleaner.

Figure 10:
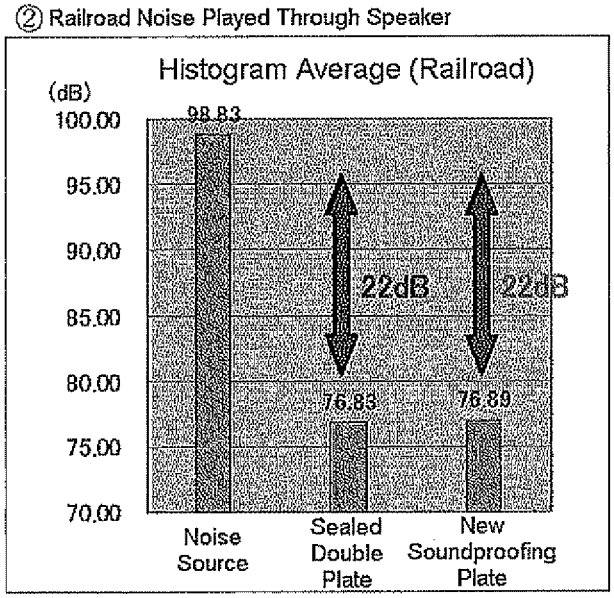
FIG. 10 A graph showing the soundproofing effect of the present invention (reproduction of traffic noise through a speaker).
Figure 11:
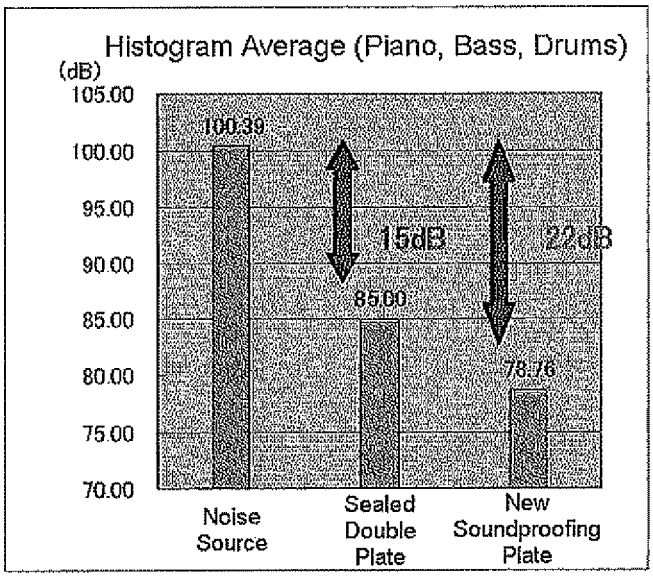
FIG. 11 A graph showing the soundproofing effect of the present invention (sound of a musical instrument).
Figure 12:
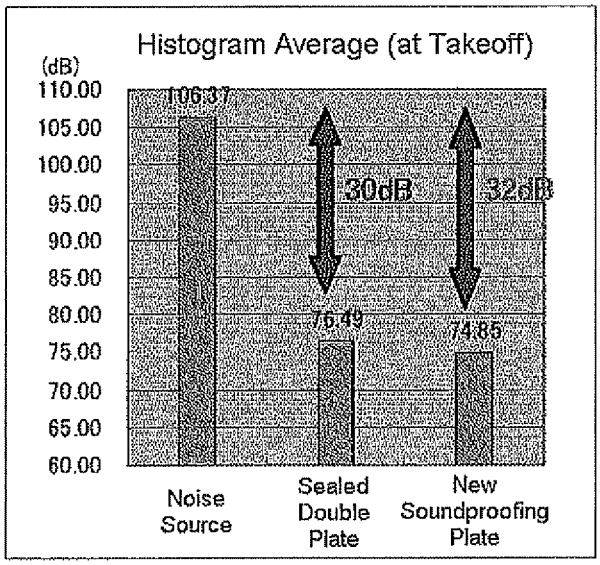
FIG. 12 A graph showing the soundproofing effect of the present invention (aircraft noise).

Both the arrangement of the second embodiment (new soundproofing plate) and the comparative example (sealed double plate) provided a soundproofing effect of at least 22 dB with respect to a noise source of traffic noise as shown in FIG. 9. This effect was the same when reproducing railroad noise with a speaker as shown in FIG. 10. When the noise source is a musical instrument (piano, bass and drums), the soundproofing effect due to the sealed double plate which is the comparative example is slightly reduced and the difference from the noise source is about 15 dB as shown in FIG. 11, but the soundproofing plate of Embodiment 2 according to the present invention provided a soundproofing effect of 22 dB even in this case. Furthermore, in the case of FIG. 12 using the sound of an airplane taking off, both Embodiment 2 and the sealed double plate of the comparative example had a soundproofing effect of more than 30 dB. In other words, the soundproofing effect of the soundproofing plate of Embodiment 2 was at least equivalent to a sealed double plate.

Figure 13:
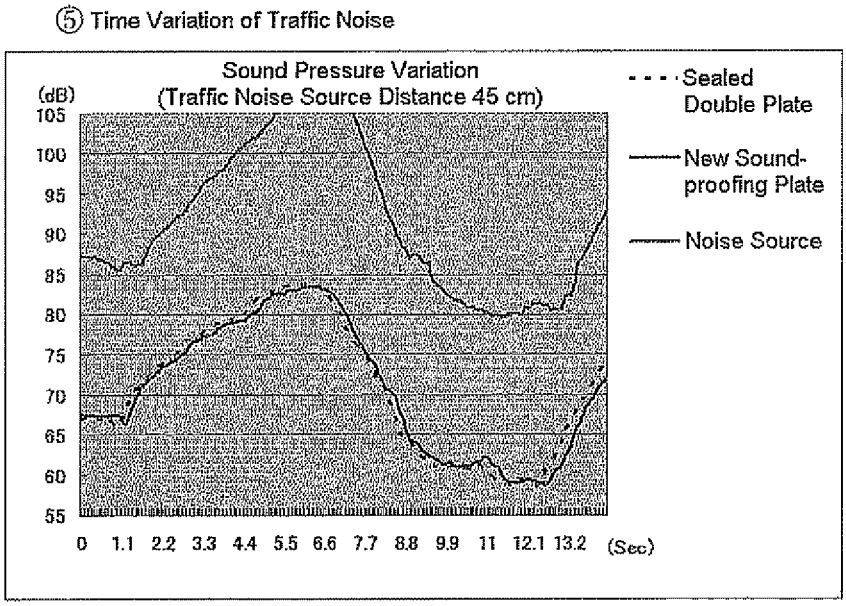
FIG. 13 A graph showing the soundproofing effect of the present invention (change of sound pressure level over time).

FIG. 13 is a graph showing the change over time of the sound pressure level of noise at the noise source and the sound pressure level of noise that passed through a soundproofing plate, using traffic noise as an example. As shown in FIG. 13, a soundproofing effect of more than 22 dB was always obtained regardless of the sound pressure level of the noise source.

In other words, the above measurement results clearly show that the soundproofing effect due to Embodiment 2 of the present invention is at least equivalent to that of a sealed double plate lacking apertures.

FIG. 14 is a schematic view showing an experimental arrangement for confirming a soundproofing effect on vacuum cleaners. The noise source 320 was housed in a box 300, and the noise level outside the box 300 was measured when a soundproofing plate 200 was mounted over the front surface aperture 310 and when a sealed double plate 330 was mounted. Additionally, the air passage effect was also evaluated by measuring the temperature in front of the noise source 320.

Figure 15:
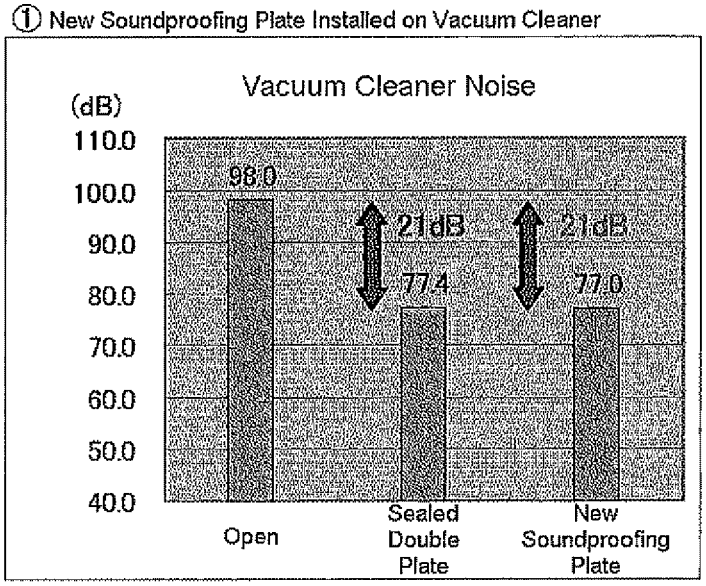
FIG. 15 A graph showing the soundproofing effect of the present invention (soundproofing plate provided in vacuum cleaner).

FIG. 15 shows the results of measurements of the noise in front of the box 300 when opening the front surface aperture 310 of the box 300, when mounting a soundproofing plate 200 according to the first embodiment, and when covering the front surface aperture 310 with a sealed double plate (sealed double plate) lacking apertures instead of the soundproofing plate 200. While the noise in front of the box 300 was 98 dB when the front surface, aperture 310 was opened, it was about 77 dB when covered with Embodiment 2 and a double plate (sealed double plate) lacking apertures on the front surface, thus providing a soundproofing effect of more than 20 dB. In other words, in this experiment as well, the soundproofing effect when installing the second embodiment on the front surface aperture 310 was entirely equivalent to or better than that for a double plate (sealed double plate) without apertures.

Figure 16:
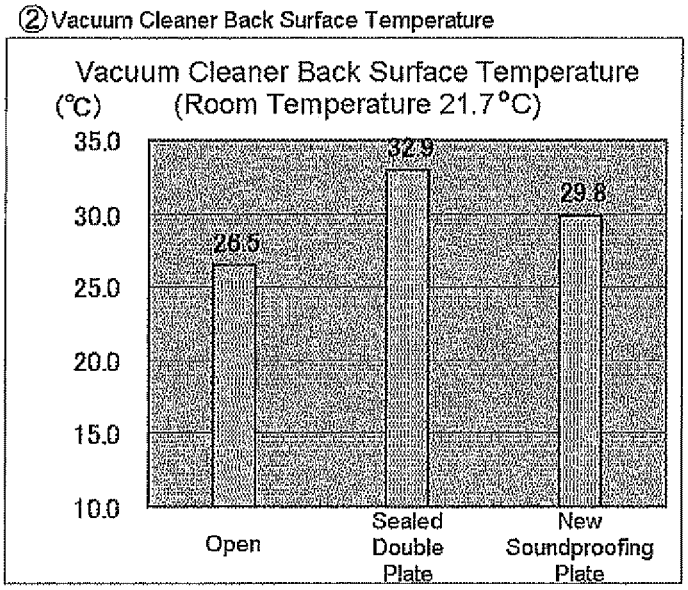
FIG. 16 A graph showing the air passage effect of the present invention (vacuum cleaner back surface temperature).

The results of measurement of the temperature on the front surface of an electrical vacuum cleaner in that case are shown in FIG. 16. While the outside air temperature was 21.7° C., the temperature in the case of Embodiment 2 was 29.8° C., and when blocking the front surface aperture 310 with a sealed double plate, 32.9° C. When compared to 26.5° C. when opening the front surface aperture 310, the temperature for Embodiment 2 was slightly higher, but not enough to be considered a notable increase, indicating that there was sufficient ventilation. On the other hand, when the front surface aperture 310 was blocked with a sealed double plate, the temperature increase inside the box 300 was naturally significant due to the lack of ventilation.

In other words, the soundproofing plate 200 of Embodiment 2 had soundproofing performance at least equivalent to a sealed double plate lacking an aperture, while achieving ventilation close to that for the case where the entire front surface is open.

FIG. 17 shows an experimental system wherein a rack-mounted computer was housed in the box 350 instead of the electrical vacuum cleaner, and similarly, the noise and temperature were measured when a soundproofing plate 200 was installed on the box front surface 352, and when the box front surface 352 was blocked with a sealed double plate lacking an aperture.

Figure 18:
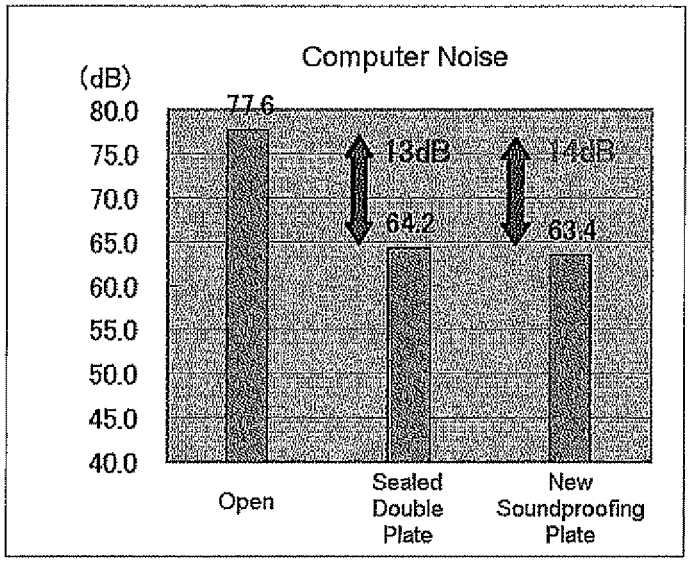
FIG. 18 A graph showing the soundproofing effect of the present invention (rack-mounted computer).

In this case also, as shown in FIG. 18, the soundproofing effect due to Embodiment 2 of the present invention was 14 dB, demonstrating that a soundproofing effect at least equivalent to the case where the box front surface 352 is completely closed off with a sealed double plate lacking apertures is achieved.

Figure 19:
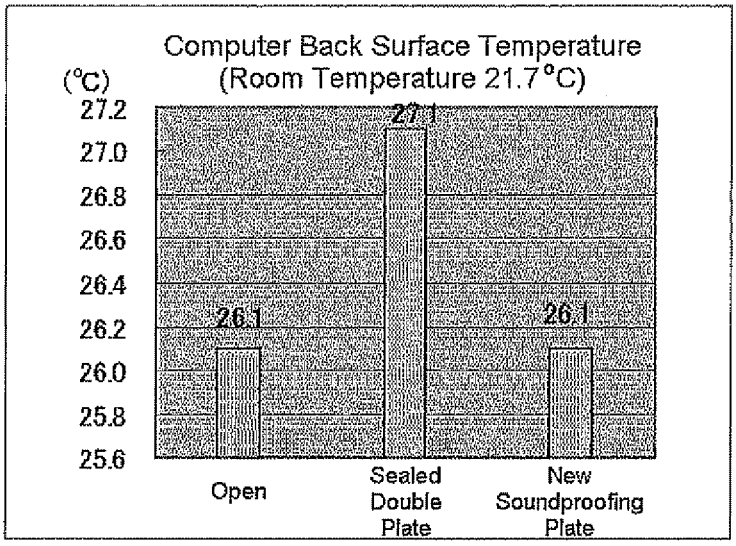
FIG. 19 A graph showing the air passage effect of the present invention (rack-mounted computer).

The temperature increase in this case is shown in FIG. 19. While the room temperature was 21.7° C., the temperature was 26.1° C. both when 352 was completely open and when a soundproofing plate 200 was installed over the box front surface 352, so the temperature increase was very slight. On the other hand, the temperature rose to 27.1° C. when the box front surface 352 was blocked with a sealed double plate lacking apertures. In other words, in this experiment as well, the temperature increase suppressing effect for the structure of Embodiment 2 of the present invention was comparable to that when the box front surface 352 was completely open.

Furthermore, a soundproofing plate 200 based on Embodiment 1 of the present invention was installed in the windows of an office building, and the degree of insulation of outdoor noise was measured. FIG. 20 is a diagram showing the concept of the measuring system at this time.

Figure 21:
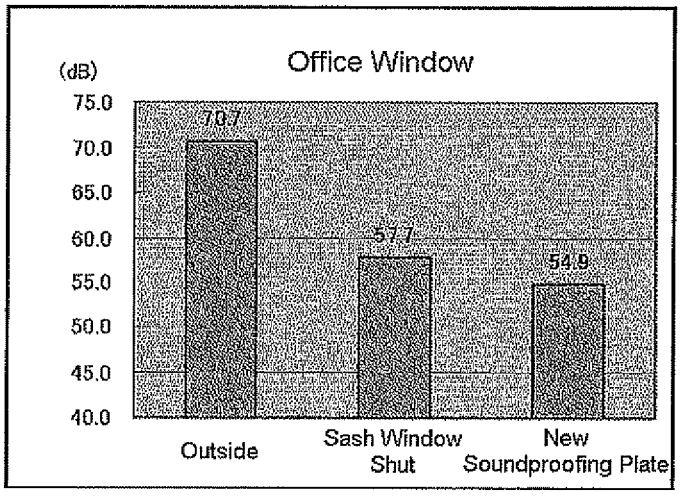
FIG. 21 A graph showing the soundproofing effect of the present invention (comparison with a sash window in an office).

FIG. 21 shows the noise level measurement results inside and outside the window. While the noise level outside the window was 70.7 dB, the noise level indoors when the sash windows were completely closed fell to 57.7 dB. On the other hand, when a soundproofing plate 200 according to Embodiment 1 of the present invention was installed in the window, the soundproofing effect was surprisingly greater than when the sash window was completely closed, the indoor noise level falling to 54.9 dB.

Figure 22:
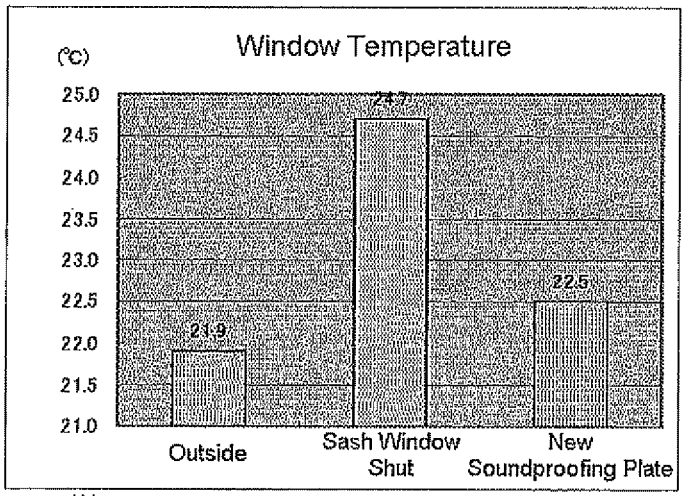
FIG. 22 A graph showing the air passage effect of the present invention (comparison with a sash window in an office).

FIG. 22 is a graph showing the room temperature as measured over a long period of time in the above-described state. While the outside air temperature was 21.9° C., the room temperature when closing the sash windows rose to 24.7° C., but when using Embodiment 1 of the present invention, the room temperature only rose to 22.5° C., so the temperature increase over the outside air temperature was very slight.

Figure 23:
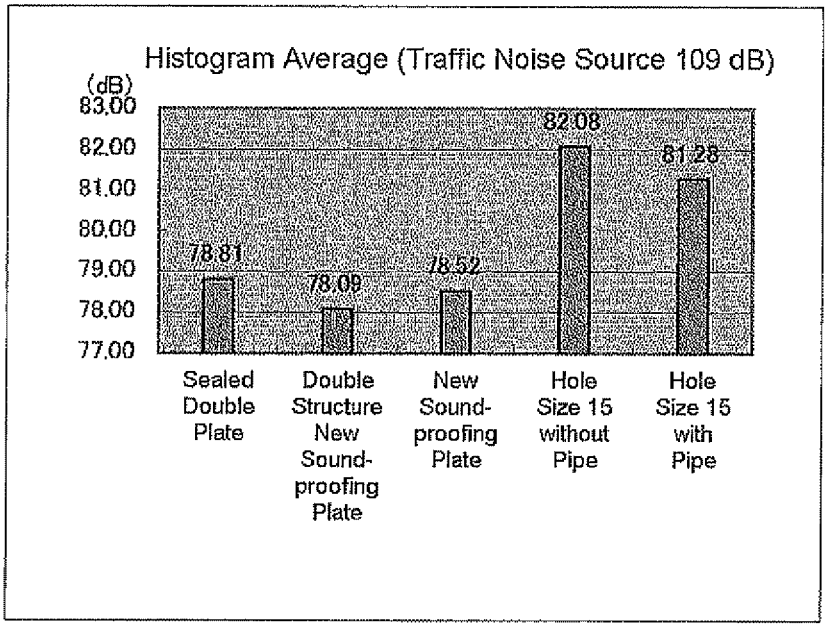
FIG. 23 A graph showing the effects of the shape of the present invention (presence/absence of sound collecting portion etc.).

On the other hand, FIG. 23 shows the results of measurements of the soundproofing effect when changing the shape of the sound collecting portion of the soundproofing plate according to the first embodiment. While the noise level of the noise source was 109 dB, the noise level through a sealed double plate lacking apertures was 78.81 dB, while that for Embodiment 1 (new soundproofing plate) of the present invention was 78.52 dB and that for Embodiment 2 (double structure new soundproofing plate) was 78.09, so in both cases, a soundproofing effect of at least a sealed double plate without apertures was achieved. In Embodiment 1, the diameter of the hole provided in the substrate was 40 mm, and the diameter of the hole in the tubular pipe was 15 mm. In the graph, "hole size 15 without pipe" and "hole size 15 with pipe" both had hole diameters of 15 mm in the plate and the tubular pipe.

Figure 24:
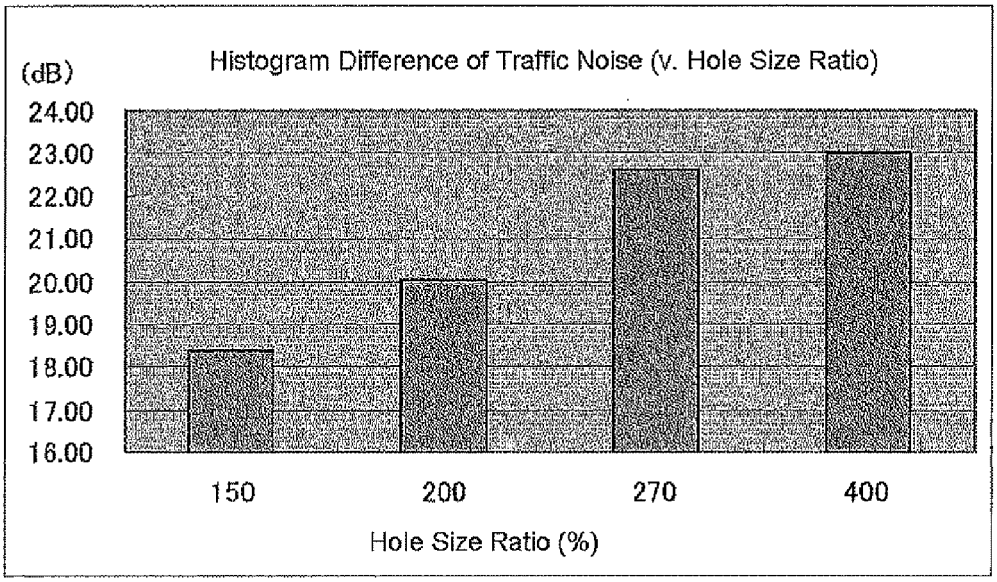
FIG. 24 A graph showing the effects of the shape of the present invention (hole diameter ratio).

FIG. 24 shows the results of measurement of the soundproofing effect according to Embodiment 1 with the maximum diameter of the sound collecting surface and the diameter of the through hole as a variable (hole diameter ratio). This shows that the soundproofing effect is improved as the hole diameter ratio increases from 150% to 400%.

Figure 25:
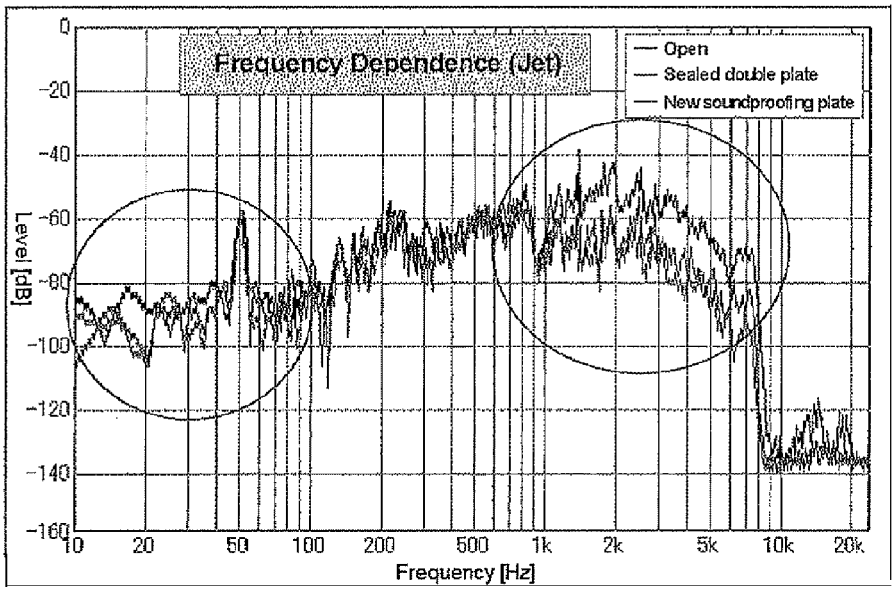
FIG. 25 A frequency distribution chart showing the soundproofing effect of the present invention (aircraft noise).
Figure 26:
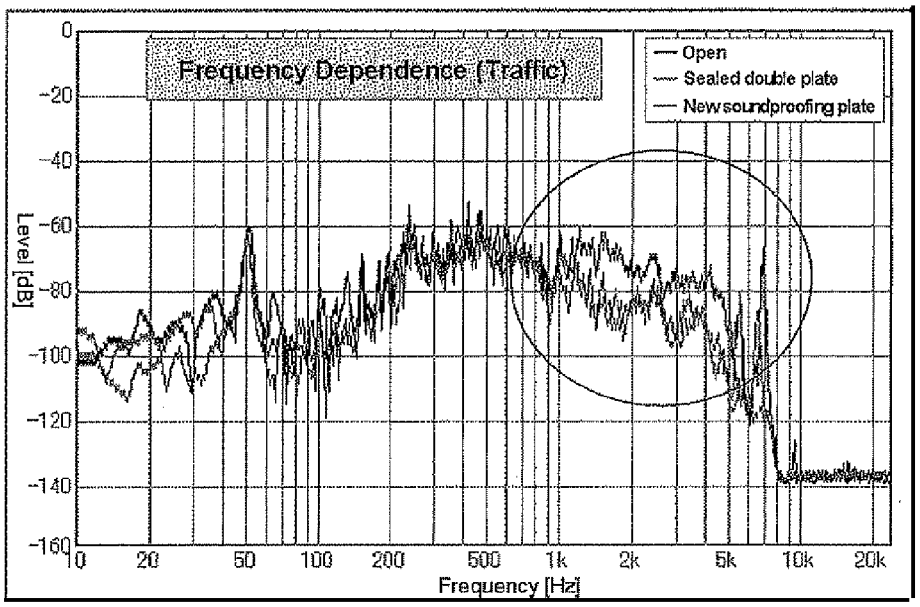
FIG. 26 A frequency distribution chart showing the soundproofing effect of the present invention (traffic noise).

FIG. 25 compares the noise reducing effect against aircraft noise for a sealed double plate without apertures and Embodiment 1 (indicated as "new soundproofing plate" in the graph) by frequency. As shown in FIG. 25, the effect of Embodiment 1 is significant at low frequencies of 100 Hz and below, and mid- to high frequencies of 1000 Hz and above. This tendency also applies when considering traffic noise as shown in FIG. 26.

Figure 27:
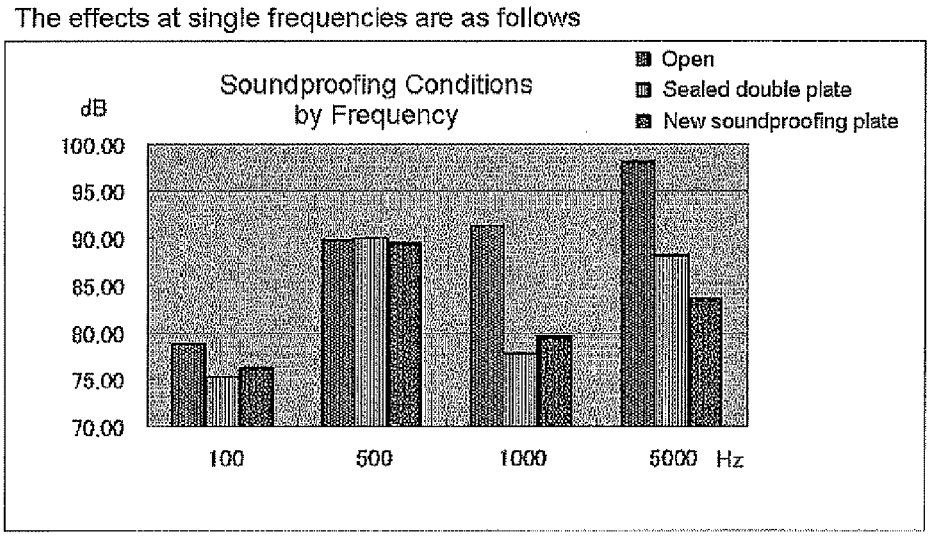
FIG. 27 A graph showing the soundproofing effect of the present invention (input by frequency).

On the other hand, FIG. 27 compares the soundproofing effect against sine waves of four frequencies. As indicated by FIGS. 25 and 26, the reducing effect was large at 100 Hz, 1000 Hz and 5000 Hz for sine waves as well, but the reducing effect was not remarkable at 500 Hz.

Tests were performed using a soundproofing plate and tubular pipe of acrylic, a wedge-shaped pipe of silicone rubber or acrylic, or a powder molded article coated with rubber. Upon measuring the maximum sound pressure using a hard wedge-shaped pipe of acrylic, the results were not very different from those for silicone rubber. As materials aside from the above, effects similar to those described above can be expected for concrete, iron and plastic materials such as polycarbonates and polyethylenes.

Herebelow are results from various experiments performed on the structure of Embodiment 2. The details of the experimental conditions are the same as for the experiment on Embodiment 1 above. The dimensions of the structures used in the experiments are shown in Table 1.

TABLE 1

| No. | Hole Diameter (noise side, mm) | Hole Diameter (outside, mm) | Pipe Diameter (mm) | Maximum Value (dB) |
|---|---|---|---|---|
| 0 | no hole | no hole | no pipe | 78.4 |
| 1 | 40.0 | 25.0 | 25.0 | 77.8 |
| 2 | 40.0 | 25.0 | 18.0 | 77.6 |
| 3 | 40.0 | 15.0 | 10.0 | 78 |
| 4 | 25.0 | 40.0 | 25.0 | 77.8 |
| 5 | 25.0 | 40.0 | 18.0 | 77.8 |
| 6 | 15.0 | 40.0 | 10.0 | 77.1 |
| 7 | 40.0 | 40.0 | no pipe | 79.3 |
| 8 | 40.0 | 25.0 | no pipe | 78.6 |
| 9 | 25.0 | 40.0 | no pipe | 78.4 |

Figure 28:
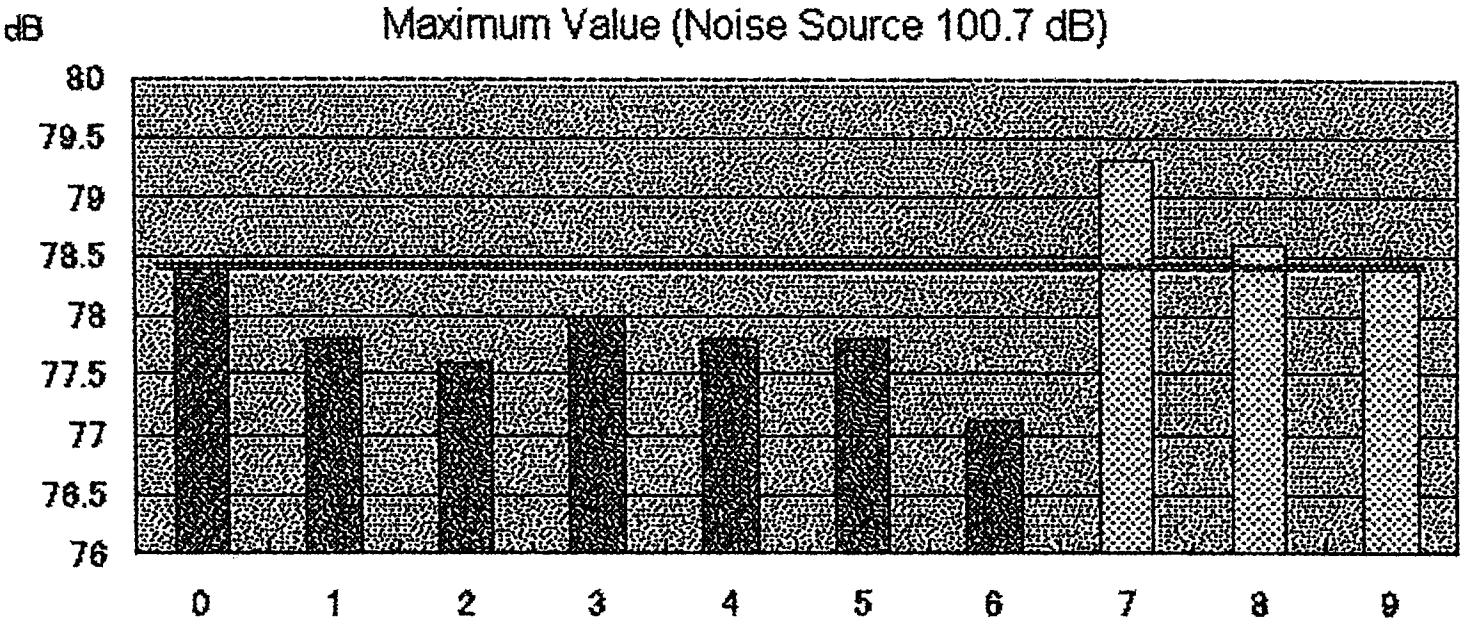
FIG. 28 A graph showing the soundproofing effect for each structure.

Number 0 in FIG. 28 corresponds to a double structured plate with no holes as described above, intended to approximate a double window blocking passage of outside air. Numbers 1 to 6 correspond to soundproofing plates with holes, having through holes, the through holes communicating via a pipe, and numbers 7 to 9 correspond to double structured plates with holes but without a pipe communicating between the through holes. The table shows that there is a soundproofing effect equal to or greater than that for a double structured plate without holes for all soundproofing plates with holes wherein the through holes are connected by a pipe. When there is no pipe connecting the through holes, the effects are not greater than those for a double structured plate without holes.

The experimental arrangement was the same as in FIG. 14, and as a noise source, a commercially available electrical vacuum cleaner was inserted into the noise source box with the exhaust port facing the front side window instead of the aforementioned speaker. As with the embodiment with the speaker, a soundproofing plate with holes or a double structured plate without holes was installed and the gaps were sealed with duct tape. The power cord for the vacuum cleaner was passed through the back surface of the noise source box, and this gap was also sealed with duct tape. The noise measurements were performed at a point 30 cm from the exhaust port in the direction of the exit. Additionally, the temperature inside the noise source box was measured 5 minutes after initiating operation of the vacuum cleaner. The soundproofing plate with holes that was used had a hole diameter (outside×inside=40×25) and pipe diameter of 18 mm. The room temperature was 21.8° C. The measurement results are shown in Table 3.

TABLE 3

| | Lid Open | Double Plate without Holes | Soundproofing Plate with Holes |
|---|---|---|---|
| Vacuum cleaner operated 5 min (Max dB) | 98 | 77.4 | 77 |
| Temperature 10 cm inside vacuum cleaner exhaust fan (° C.) | 26.5 | 32.9 | 29.8 |

In this case as well, a soundproofing effect equivalent to or greater than a double structured plate without holes was observed in the soundproofing plate with holes. While it is important for machines having fans such as vacuum cleaners to be kept at a constant temperature during operation, the double structured plate without holes was 6.4° C. higher than when the lid was open, and the soundproofing plate with holes had an increase of only 3.3° C., so a soundproofing effect was clearly obtained while suppressing machine temperature increases.

If the structural device of the present invention is made capable of being easily removed by using magnets or Velcro® in the periphery of a fan exhaust port, there is no need to produce them for use in each vacuum cleaner, enabling them to be offered economically.

Next, as with the experimental arrangement shown in FIG. 20, the soundproofing plate with holes was installed in the window of an office. On the right side of a sash window of width 1400 mm×height 1800 mm, three soundproofing plates 200 were installed vertically. The hole diameter of the soundproofing plates with holes that was used was window outside×inside=40×25 mm, and the pipe diameter was 18 mm. The gaps between the soundproofing plates with holes and the sash were sealed with duct tape.

Figure 29:
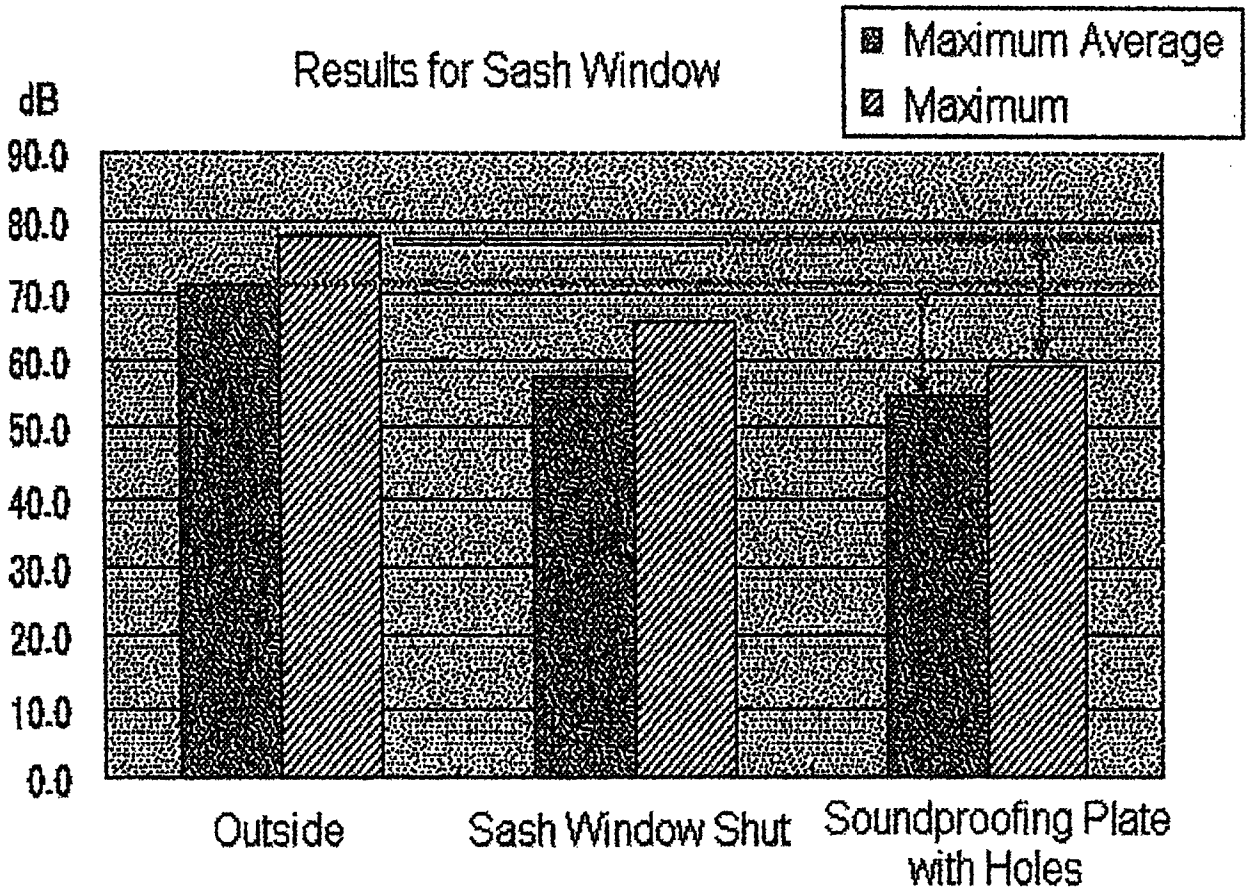
FIG. 29 A graph showing the average maximum value and the average maximum value of all the measurements.

Noise measurements were made six times an hour at a position 10 cm into the room from the sash window, or soundproofing plate with holes. The average maximum value and maximum value of all the measurements are shown in Table 4. Additionally, they are graphed in FIG. 29. The average of the maximum refers to the overall average of maximum values for each measurement, while the maximum refers to the maximum across all measurements. The temperature was measured at a point 10 cm to the outside of a sash window, and a point 10 cm indoors from the sash window and the soundproofing plate with holes.

TABLE 4

| | Outside | Sash Window Shut | Soundproofing Plate with Holes |
|---|---|---|---|
| Maximum Average (dB) | 70.7 | 57.7 | 54.9 |
| Maximum (dB) | 78.2 | 65.8 | 59.1 |
| Temperature (° C.) | 21.9 | 24.7 | 22.5 |

Outside Air Temperature: 21.6° C. Indoor Temperature: 24.9° C.

Compared to outside the sash window, a clear soundproofing effect of at least 15 dB was observed for soundproofing plate 200. The temperature was also clearly close to the outside air temperature compared to when the sash window was closed, showing that the temperature was neutralized by passage of air. The actual physical sensation felt less stuffy and cooler than the measured temperature, perhaps due to the fact that a natural breeze could be felt. At this time, the wind outside was a slight breeze that was almost unnoticeable. The indoor temperature was 24.9° C. which is just barely the temperature at which air conditioning is usually needed, but the necessity was not felt at a seat beside a window on which the soundproofing plate of the present invention was installed.

By increasing the installation area of the soundproofing plate with holes, the difference from the outside air was able to be further reduced. Additionally, in combination with a sash window, it was possible to easily reduce air conditioning energy by shutting the sash window when air conditioning was needed and opening the sash when not needed.

The invention was applied to a computer in accordance with FIG. 17. A soundproofing plate with holes and a double structure plate without holes were attached to a frame installed in the periphery of the fan portion of a rack-mounted computer. The gaps were sealed with duct tape. The computer was continually run for 24 hours. The measured values were the maximum value of noise in 10 minutes at a point 10 cm in the exhaust direction from the fan portion and the temperature at a point 5 cm to the side of the fan portion inside frame. The measurement results are shown in Table 6.

TABLE 6

| | Lid Open | Double Plate without Holes | Soundproofing Plate with Holes |
|---|---|---|---|
| Computer Fan Exit (Max dB) | 77.6 | 64.2 | 63.4 |
| Temperature Near Fan (° C.) | 26.1 | 27.1 | 26.1 |

As with the other embodiments, the soundproofing plate with holes had soundproofing effects equivalent to or greater than a double structure plate without holes. Additionally, the temperature near the fan was also the same as when open, showing that there was sufficient passage of air.

Normally, rack-mounted computers are designed to be housed on a shared rack, often having the same shape in the vicinity of the fan portion, enabling the structure of the present invention to be mass-produced, so as to be able to be offered at an economical price.

As a result of the above experiments, the following trends can be observed. With plate hole diameter/"tubular pipe" hole diameter (hole diameter ratio) in the range of 150% to 400%, the soundproofing effect was greater as the ratio increased. As for the ratio of plate hole area/total plate area (aperture ratio), an effect was observed at 4% to 30%. As for the curvature, the ratio R/pipe external measurement=1.25 to 0.5 was preferable. In fact, when the external measurement was 40 mm, R was tested at 20 to 40 mm (radius). While some soundproofing effect was observed even with only a "tubular pipe", the effect was small. While some soundproofing effect was observed simply by opening the aforementioned holes in the plate, the effects were small.

As for the type of noise, samples of traffic noise which is the collective sound of automobiles, jet engine noise (at take-off), passage of railway cars and music arranged for piano, bass and drums were adjusted to 80 to 120 dB, and used on speakers for the tests. As a result, similar effects were observed for all (though with slight differences).

The tests were performed with acrylic and with rubber-coated surfaces. Aside therefrom, similar effects can be expected for glass and plastics such as PET resin. However, when to be installed in a window, a transparent or colored semi-transparent material is desirable in order to obtain a light-transmitting effect. Additionally, depending on the conditions, it may be preferable to use materials with weight and a large sound wave attenuation capability such as concrete, steel-reinforced concrete or steel as the substrate, in which case the attenuation element should preferably be implanted in the substrate so as not to protrude from the substrate. Additionally, even in this case, it may be preferable to use a double substrate or a substrate having enough thickness to bury the attenuation elements. Plastic materials such as polycarbonates, polyethylenes and polyacrylates may of course be used.

Additionally, regarding the shape:

1) A soundproofing plate with an air passage effect wherein a "wedge-shaped hollow pipe" is provided on each of a plurality of holes with a diameter of at least 15 mm and at most 40 mm opened in a single plate. A "wedge-shaped hollow pipe" refers to a "tubular pipe" with a diameter of at least 10 mm and at most 30 mm and a length of at least 5 mm, having a "trumpet-shaped pipe (flared pipe)" with a larger diameter of at least 15 mm and at most 40 mm at both ends thereof, one end of which is connected to a hole in the aforementioned plate.

2) Similar effects can be expected also when using a double-structured soundproofing plate wherein the other end of the above-described "wedge-shaped hollow pipe" attached to the plate is attached to a hole opened in a plate similar to that described above, and the gaps between the plates are sealed.

DESCRIPTION OF THE REFERENCE NUMBERS

10, 30 substrate
20 through hole
32 top/bottom plate
34 side surface plate
100 attenuation element
110 hollow axial member
120 sound collecting portion
122 sound collecting surface
130 through hole
200 soundproofing plate

The invention claimed is:

1. A soundproofing plate, comprising:

a substrate on which are formed a plurality of through holes; and a first sound collecting portion and a second sound collecting portion, the sound collecting portions each having in the center a through hole approximately aligned with a through hole of the substrate, wherein a diameter of each sound collecting portion increases as the distance from the substrate increases; and the sound collecting portions are provided, outside the substrate, on both surfaces of the substrate.

2. A soundproofing plate, comprising:

a substrate on which are formed a plurality of through holes; and an attenuation element comprising a hollow axial member, and a pair of sound collecting portions, each sound collecting portion being affixed to a respective end of the hollow axial member, the sound collection portions each having in the center a through hole approximately aligned with a hollow portion of the hollow axial member, wherein a diameter of each of the sound collecting portions increases as the distance from the hollow axial member increases; and the hollow axial member is provided on the substrate so as to be approximately centrally aligned with a through hole of the plurality of through holes.

3. The soundproofing plate according to claim 2, wherein the attenuation element is provided on one side of the substrate.

4. The soundproofing plate according to claim 2, wherein the hollow axial member penetrates through the substrate.

5. The soundproofing plate according to claim 1, wherein the shape of the sound collecting portion is spherical, elliptical, parabolic or conical.

6. The soundproofing plate according to claim 1, wherein the shape of the sound collecting portion is that of a three-dimensional surface traced by moving a two-dimensional arc, ellipse, parabola, hyperbola or straight line in a direction perpendicular to a two-dimensional plane of the sound collecting portion, and an edge portion of the sound collecting portion is rectangular.

7. The soundproofing plate according to claim 6, wherein the plurality of sound collecting portions are disposed so that edge portions come into mutual contact, substantially covering an entire area of the substrate.

8. The soundproofing plate according to claim 2, wherein the shape of the sound collecting portion is spherical, elliptical, parabolic or conical.

9. The soundproofing plate according to claim 2, wherein:

the shape of the sound collecting portion is that of a three-dimensional surface traced by moving a two-dimensional arc, ellipse, parabola, hyperbola, or straight line in a direction perpendicular to a two-dimensional plane of the sound collecting portion, and an edge portion of the sound collecting portion is rectangular.

10. The soundproofing plate according to claim 9, wherein the plurality of sound collecting portions are disposed so that edge portions come into mutual contact, substantially covering an entire area of the substrate.

* * * * *